US005884712A

United States Patent [19]

Häkkinen

[11] Patent Number: 5,884,712

[45] Date of Patent: Mar. 23, 1999

[54] ARRANGEMENT FOR A TELESCOPE FEEDER OF A ROCK-DRILLING MACHINE

[75] Inventor: Leo Häkkinen, Tampere, Finland

[73] Assignee: Tamrock Oy, Finland

[21] Appl. No.: 973,907

[22] PCT Filed: May 31, 1996

[86] PCT No.: PCT/FI96/00323

§ 371 Date: Dec. 17, 1997

§ 102(e) Date: Dec. 17, 1997

[87] PCT Pub. No.: WO97/01019

PCT Pub. Date: Jan. 9, 1997

[30] Foreign Application Priority Data

Jun. 20, 1995 [FI] Finland ..... 953053

[51] Int. Cl.[6] ..... E21C 5/10

[52] U.S. Cl. ..... 173/11; 173/19; 173/193

[58] Field of Search ..... 173/11, 13, 15, 173/17, 19, 38, 39, 44, 193, 194, 195, 152, 156

[56] References Cited

U.S. PATENT DOCUMENTS

| | | | |
|---|---|---|---|
| 3,744,575 | 7/1973 | Strommes | 173/193 |
| 3,880,244 | 4/1975 | Boom et al. | 173/193 |
| 3,889,906 | 6/1975 | Kimber | 173/38 |
| 3,999,805 | 12/1976 | Lockwood | 173/193 |
| 4,246,973 | 1/1981 | Mayer | 173/11 |
| 4,257,489 | 3/1981 | Westerberg | 173/19 |
| 4,499,953 | 2/1985 | Molin | 173/194 |

FOREIGN PATENT DOCUMENTS

| | | |
|---|---|---|
| 213953 | 7/1967 | Sweden . |

*Primary Examiner*—Scott A. Smith
*Attorney, Agent, or Firm*—Nixon & Vanderhye P.C.

[57] ABSTRACT

An arrangement is provided for a telescope feeder of a rock-drilling machine, having two telescopic portions, between which is connected an extension cylinder so that the rock-drilling machine moves along one telescopic portion. The extension cylinder comprises a separate adjusting piston, which is mounted movably around the piston rod so that it can move irrespective of the piston of the extension cylinder. Three cylinder spaces are thus formed inside the extension cylinder and to each cylinder space is connected a separate channel for pressure medium, so that the adjusting piston can be displaced to a desired position.

2 Claims, 2 Drawing Sheets

ARRANGEMENT FOR A TELESCOPE FEEDER OF A ROCK-DRILLING MACHINE

BACKGROUND AND SUMMARY OF THE INVENTION

The invention relates to an arrangement for a telescope feeder of a rock-drilling machine, a feed beam of which feeder consists of two telescopic portions moving mutually in their longitudinal direction, between which portions is connected an extension cylinder, inside which moves a piston in such a way that the extension cylinder is connected to one telescopic portion and the piston rod is connected to the other telescopic portion in order to displace those portions with respect to each other, whereby the rock-drilling machine moves along one telescopic portion by means of a separate feed cylinder.

Telescope feeders are used in a rock-drilling machine in a situation when it is necessary to drill holes of different lengths in different circumstances, owing to which a long feed beam cannot always be used. In such a telescope feeder, the feed beam consists of two feed beam portions moving in their longitudinal direction with respect to each other, whereby for drilling with the shortest drill rod is only needed a motion of the drilling machine with respect to one feed beam portion, but for drilling with drill rods longer than that the feed motion consists both of the motion of the drilling machine along one feed beam portion and of a mutual motion of the feed beam portions.

One problem with the known solutions is that when the feed beam portions are displaced with respect to each other, their position cannot be accurately determined without complicated measuring devices. A consequence of this is that the feed motion is difficult to control and it causes extra work and inconveniences. On the other hand, for drilling holes of predetermined lengths a continuous measurement of drill rod motion is required, which also is difficult and demands a continuous observation on the part of the driller.

The object of the present invention is to provide such an arrangement for a telescope feed beam of a rock-drilling machine by which the feed length can be easily arranged as desired and locked thereto in such a way that no measuring steps are necessary after the first setting before the length of the drill rod or the depth of the hole to be drilled is changed. The arrangement according to the invention is characterized in that the extension cylinder comprises separate adjusting piston mounted movably around the piston rod so that it can move irrespective of the piston of the extension cylinder, whereby three separate cylinder spaces are formed inside the extension cylinder, and that to each cylinder space is connected a separate channel for pressure medium, whereby the adjusting piston can be displaced to a desired position with respect to the extension cylinder or the piston and it can be locked thereto.

The essential idea of the invention is that the extension cylinder between the feed beam portions comprises a separate adjusting piston, which can move around the piston rod of the cylinder in the longitudinal direction of the cylinder, whereby three spaces for pressure medium are formed in the cylinder and whereby the flow of pressure fluid into one of these spaces or out of it can be closed in such a way that the adjusting piston restricts the stroke length of the piston of the extension cylinder to a desired dimension. In this manner it is possible to adjust the length of motion between the beam portions of the telescope feed beam in such a way that the desired drilling length is achieved.

The invention will be described in more detail below in connection with the attached drawings.

DETAILED DESCRIPTION OF THE DRAWINGS

Figure 1:
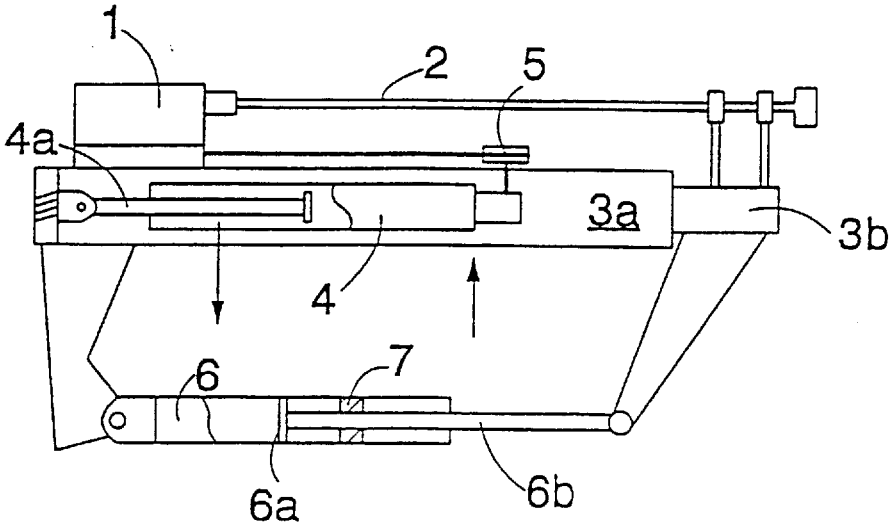
FIG. 1 shows schematically how an arrangement according to the invention for a telescope feed beam of a rock-drilling machine is provided.

FIG. 1 shows a rock-drilling machine 1, to which can be connected a drill rod 2 for drilling a hole into a rock. The rock-drilling machine 1 is mounted movably in its longitudinal direction, i.e. in the drilling direction, on a telescope feed beam consisting of an outer telescopic portion 3*a* and an inner telescopic portion 3*b*. The rock-drilling machine is mounted movably on the outer telescopic portion 3*a* in such a way that it can move essentially along the whole length of the telescopic portion 3*a*. For this purpose, a feed cylinder 4 is mounted thereon, the piston 4*a* of the cylinder being at one end connected to the outer telescopic beam portion 3*a* of the feed beam. The cylinder is connected to a feed roller 5, around which a feed wire or chain or the like displacing the drilling machine 1 runs in a manner known per se. Since displacing a rock-drilling machine along a feed beam and various devices used for this purpose are fully known per se and obvious to one skilled in the art, these facts have not been considered to need a description in greater detail.

Between the telescopic portions 3*a* and 3*b* of the feed beam, there is an extension cylinder 6 having a piston 6*a* inside. The rod 6*b* of the piston 6*a* is connected to one of the telescopic portions, in the figure to the inner telescopic portion 3*b*, and respectively, the cylinder is connected to the other telescopic portion, in the figure to the outer telescopic portion 3*a*. The figure shows the extension cylinder schematically, mounted outside the telescopic portions 3*a* and 3*b* parallel with them, but if desired, it can also be mounted inside the telescopic portions 3*a* and 3*b* in a manner known per se. In the extension cylinder 6 there is further an adjusting piston 7 moving around the piston rod 6*b* and dividing the liquid space of the cylinder 6 from the piston towards the piston rod into two separate spaces. Moreover, the telescope feed beam 3 can be connected in a manner known per se fixedly or movably to a boom or a cradle not shown, which is, however, not essentially associated with the invention and for this reason not described more accurately.

Figure 2:
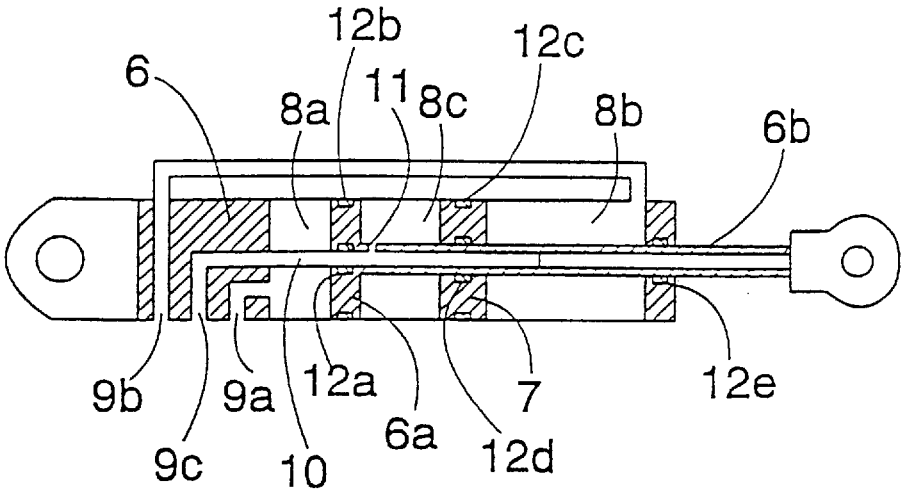
FIG. 2 shows an extension cylinder used for the arrangement according to the invention in more detail schematically and FIG. 3 shows schematically a hydraulic connection suitable for the arrangement according to the invention.

FIG. 2 shows schematically an extension cylinder 6, inside which moves a piston 6*a*, the rod 6*b* of the piston extending outside the extension cylinder 6. Around the piston rod 6*b* there is an adjusting piston 7, whereby three cylinder spaces 8*a*, 8*b* and 8*c* are formed in the cylinder 6. For feeding pressure fluid into the separate cylinder spaces, the extension cylinder 6 comprises three feed channels for pressure fluid, one 9*a* of the channels leading to the cylinder space 8*a*, and respectively, one 9*b* of them leading to the cylinder space 8*b* at the other end of the cylinder 6. Into the cylinder space 8*c* between the piston 6*a* and the adjusting piston 7 is fed pressure medium in such a way that there is a separate feed pipe 10 for pressure fluid in the middle of the extension cylinder 6, which pipe extends through the piston 6*a* into the hollow piston rod 6*b*. One or more holes 11 lead through the wall of the piston rod 6*b* into the cylinder space 8*c*. To prevent an unnecessary flow of pressure fluid, the pipe 10 as well as, of course, the piston 6*a* and the adjusting piston 7 and the piston rod 6*b* are sealed both mutually and with respect to the inner surface of the cylinder 6 by means of seals 12*a* to 12*e*.

The stroke length of the extension cylinder can be set by feeding a desired amount of pressure medium either into the cylinder space 8*b* or 8*c* and by using the remaining cylinder spaces for displacing the piston 6*a* with respect to the cylinder 6. If the cylinder space 8*b* is used as an adjusting space, it can be done in such a way that the piston 6*a* is at first displaced to the right in the figure with respect to the cylinder 6 so that the adjusting piston 7 moves to a desired point. Subsequently, the flow of pressure fluid into and out of the cylinder space 8*b* is closed, whereby the adjusting piston is locked in its place and the piston 6*a* as well as the piston rod 6*b* can be displaced with respect to the cylinder 6 by leading pressure medium either into the cylinder space 8*a* or 8*c*, as per need. In the same way, the stroke length can be adjusted by displacing the adjusting piston to the outer end of the cylinder 6, i.e. to the right edge in the figure, by feeding pressure fluid either into the cylinder space 8*a* or 8*b*. When the flow of pressure fluid into the cylinder space 8*b* is closed after this and pressure fluid is fed into the cylinder space 8*c* through a channel 9*c*, the piston 6*a* and thus the length of the extension cylinder 6 can be set to have a desired dimension. Subsequently, the flow of pressure fluid into or out of the cylinder space 8*c* is closed by closing the channel 9*c*, whereby the piston 6*a* and together with it the adjusting piston 7 can be displaced back and forth with respect to the cylinder 6 by feeding pressure medium alternately into the cylinder space 8*a* or 8*b*.

Figure 3:
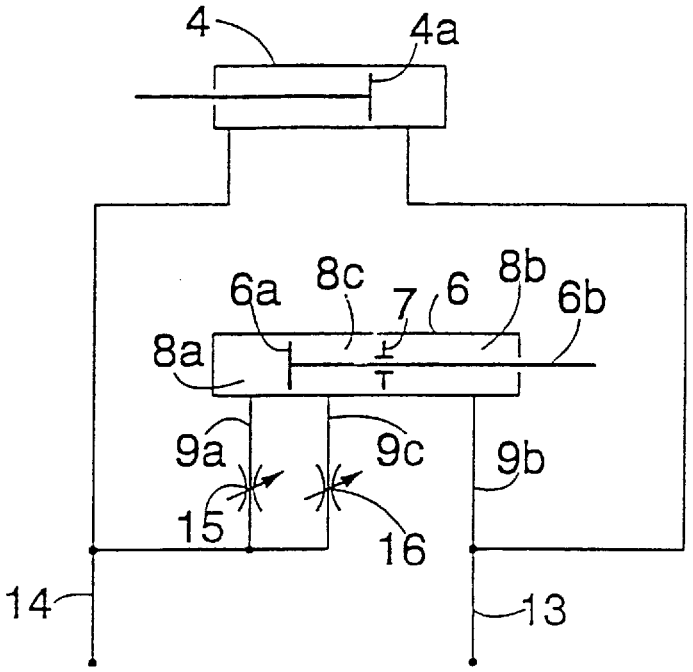

FIG. 3 shows schematically a hydraulic connection, which can be used for providing the arrangement according to the invention. Therein, a feed cylinder 4 intended for displacing a drilling machine is connected in parallel with an extension cylinder 6. When drilling is started, the feed cylinder is shortest and the extension cylinder extends as far as is adjusted by means of an adjusting piston. The adjusting piston 7 is locked in place by feeding pressure medium into a cylinder space 8*b* until the adjusting piston has taken a suitable position. Subsequently, a pressure channel leading into the cylinder space 8*b* is closed. When the feeding starts, pressure fluid is fed through a pressure fluid channel 13, whereby it flows into a space between a piston 4*a* of the feed cylinder 4 and the cylinder 4 and pushes the piston 4*a* outwards. Correspondingly, pressure fluid flows through a channel 9*c* into a space 8*c* between the adjusting piston 7 and the piston 6*a*, whereby the piston 6*a* pushes outwards from the adjusting piston 7 and the length of the extension cylinder shortens. Pressure fluid flows out of both cylinders 4 and 6 through a channel 14 into a pressure fluid container not shown. The channels 9*a* and 9*c* may also comprise in a manner shown in the figure separate preferably adjustable throttles 15 and 16, by means of which the inflow ratio of the pressure fluids into the cylinder spaces 8*a* and 8*c* can be adjusted in such a way that, with both channels open, the pistons move mutually with respect to each other in a desired manner.

When the drilling machine is moved back to the starting position, pressure fluid is fed correspondingly through the channel 14, whereby the length of the feed cylinder 4 shortens when the piston 4*a* moves inwards, and respectively, the length of the extension cylinder 6 increases when the piston 6*a* moves towards the adjusting piston 7. When a change in the position of the adjusting piston 7 is desired, the simplest way of determining the position is that the adjusting piston 7 is at first displaced against the piston 6*a*, after which the extension cylinder 6 is extended to the desired length by displacing the piston 6*a* towards the end on the adjusting piston side. By a subsequent locking of the adjusting piston in that place, the stroke length can be repeated in a simple manner without other measuring or adjusting steps.

In the specification above and in the drawings the invention has been described by way of example only and it is not in any way restricted thereto. The structure and function of the adjusting piston can be implemented in many ways, but essential is that the adjusting piston is located on the piston rod of the extension cylinder in order to make it easy to feed pressure fluid in a desired manner.

I claim:

1. An arrangement for a telescope feeder of a rock-drilling machine comprising: a feed beam having inner and outer telescopic portions moving mutually in a longitudinal direction with the rock drilling machine supported on one of said inner and outer telescopic portions; an extension cylinder connected between said inner and outer telescopic portions; an extension piston and an extension piston rod inside said extension cylinder, arranged so that the extension cylinder is connected to one of said inner and outer telescopic portions, and the extension piston rod is connected to the other of said inner and outer telescopic portions to thereby permit displacement of said inner and outer telescopic portions with respect to each other; and a separate feed cylinder for moving the rock drilling machine along said one of said inner and outer telescopic portions; wherein said extension cylinder includes a separate adjusting piston mounted movably around said extension piston rod so that said adjusting piston can move relative to said extension piston and so that three separate cylinder spaces are formed inside said extension cylinder, each cylinder space communicating with a separate channel for pressure medium, whereby the adjusting piston can be displaced to and held in a desired position either with respect to the extension cylinder or the extension piston.

2. The arrangement according to claim 1, wherein the extension piston rod of the extension cylinder is tubular and a separate feed pipe for pressure fluid extends through a middle portion of the extension cylinder, said separate feed pipe extending into the extension piston rod and having a length such that one end of said separate feed pipe is always inside the extension piston rod; and further wherein the separate feed pipe is sealed with respect to an inner space of the extension piston rod in such a way that an integral channel for pressure medium is formed; and further wherein at least one opening leads through a wall of the extension piston rod into one of said three separate cylinder spaces located between the extension piston and the adjusting piston.

* * * * *